US005181499A

United States Patent [19]

Kayanuma

[11] Patent Number: 5,181,499

[45] Date of Patent: Jan. 26, 1993

[54] APPARATUS FOR DIAGNOSING ABNORMALITY IN FUEL INJECTION SYSTEM AND FUEL INJECTION CONTROL SYSTEM HAVING THE APPARATUS

[75] Inventor: Nobuaki Kayanuma, Gotenba, Japan

[73] Assignee: Toyota Jidosha Kabushiki Kaisha, Japan

[21] Appl. No.: 842,425

[22] Filed: Feb. 27, 1992

[30] Foreign Application Priority Data

Mar. 8, 1991 [JP] Japan ..... 3-43827

[51] Int. Cl.[5] ..... F02M 51/00

[52] U.S. Cl. ..... 123/690

[58] Field of Search ..... 123/690, 688, 434, 672

[56] References Cited

U.S. PATENT DOCUMENTS

| | | | |
|---|---|---|---|
| 4,819,601 | 4/1989 | Harada et al. | 123/690 |
| 4,947,818 | 8/1990 | Kamohara et al. | 123/690 |
| 5,070,847 | 12/1991 | Akiyawa et al. | 123/690 |
| 5,090,389 | 2/1992 | Oata | 123/690 |
| 5,094,214 | 3/1992 | Kotzan | 123/690 |
| 5,126,943 | 6/1992 | Nakaniwa | 123/690 |
| 5,131,372 | 7/1992 | Nakaniwa | 123/690 |

FOREIGN PATENT DOCUMENTS

| | | | |
|---|---|---|---|
| 62-32237 | 2/1987 | Japan | 123/489 |
| 62-48939 | 3/1987 | Japan | 123/489 |
| 63-124848 | 5/1988 | Japan | 123/489 |

*Primary Examiner*—Raymond A. Nelli
*Attorney, Agent, or Firm*—Oliff & Berridge

[57] ABSTRACT

In an apparatus for diagnosing an abnormality in a fuel injection system in which an injection quantity is feedback-controlled by adjusting a first air-fuel ratio correction value so that an air-fuel ratio is equal to a target air-fuel ratio. The injection quantity is also adjusted by a second air-fuel ratio correction value. When the first air-fuel ratio correction value has reached a first upper limit value, the second air-fuel ratio correction value is set to a second upper limit value. When the first air-fuel ratio correction value has reached a second lower limit value, the second air-fuel ratio correction value is set to a second lower limit value. When the first air-fuel ratio correction value is outside of a predetermined range when a predetermined time has elapsed after the second air-fuel ratio correction value is set to either the second upper limit value or the second lower limit value, it is determined that a fault has occured in the fuel injection system.

15 Claims, 8 Drawing Sheets

APPARATUS FOR DIAGNOSING ABNORMALITY IN FUEL INJECTION SYSTEM AND FUEL INJECTION CONTROL SYSTEM HAVING THE APPARATUS

BACKGROUND OF THE INVENTION (1) Field of the Invention

The present invention generally relates to internal combustion engines, and more particularly to an apparatus for diagnosing an abnormality in an electronic control type fuel injection system of an internal combustion engine. Further, the present invention is concerned with a fuel injection control system having such an apparatus.

(2) Description of the Related Art

In an internal combustion engine equipped with an electronic control type fuel injection system, a basic fuel injection period is calculated by using an intake manifold negative-pressure and an engine speed, or the amount of intake air and an engine speed. The basic fuel injection period thus obtained is then corrected by a feedback control process based on an output detection signal from an oxygen sensor fastened to an engine exhaust passage, so that a mixture of air and fuel supplied in an engine cylinder is always equal to a target air-fuel ratio, such as a stoichiometric air-fuel ratio.

Normally, upper and lower limit values are defined with respect to an air-fuel ratio feedback correction factor FAF used for correcting the basic fuel injection period by the feedback control process in order to prevent the basic fuel injection period from being excessively corrected. If a fault has occurred in the fuel injection system, for example, if a fuel injection valve cannot be closed and remains in the open state, the air-fuel ratio feedback correction factor FAF reaches the upper or lower limit. If this state is continuously maintained within a predetermined period, it is determined that a fault has occurred in the fuel injection system (see Japanese Laid-Open Patent Application 62-32237).

However, the air-fuel ratio feedback control process is not executed while the air-fuel ratio feedback correction factor remains equal to the upper or lower limit value. As a result, exhaust emissions will increase.

This problem will now be described in more detail. In the case where the air-fuel ratio deviates from the target air-fuel ratio, the exhaust emissions will increase in different ways depending on how the injection quantity is controlled at this time. More specifically, the degree of increase of exhaust emissions observed while the injection quantity is being controlled so as to increase or decrease these emissions (that is, the feedback control is being executed) is different from that observed while the injection quantity is fixed (open-loop control). This is due to the fact that the amount of exhausted oxygen changes as the injection quantity changes and thus the amount of oxygen in a catalyst increases or decreases. As a result, the exhaust gas can be reduced to some extent. In the case where the injection quantity is fixed, a state where no oxygen is contained in the catalyst or oxygen is excessively contained therein is continuously obtained. In such cases, it is impossible to reduce the exhaust gas.

SUMMARY OF THE INVENTION

It is a general object of the present invention to provide an apparatus for diagnosing abnormality in a fuel injection system in which the above disadvantages are eliminated.

A more specific object of the present invention is to provide an apparatus for diagnosing an abnormality in a fuel injection system capable of preventing exhaust emissions from increasing.

The above objects of the present invention are achieved by an apparatus for diagnosing abnormality in a fuel injection system in which an injection quantity is feedback-controlled by adjusting a first air-fuel ratio correction value so that an air-fuel ratio is equal to a target air-fuel ratio, the apparatus comprising:

operation means for generating a second air-fuel correction value used for adjusting the injection quantity so that the first air-fuel ratio correction value is within a first predetermined range;

first comparator means for comparing the first air-fuel ratio correction value with a first upper limit value and a first lower limit value;

setting means, coupled to the first comparator means, for forcibly setting the second air-fuel ratio correction value to a second upper limit value when it is determined by the first comparator means that the first air-fuel correction value has reached the first upper limit value and for forcibly setting the second air-fuel ratio correction value to a second lower limit value when it is determined by the first comparator means that the first air-fuel ratio correction value has reached the first lower limit value;

second comparator means, coupled to the setting means, for determining whether or not the first air-fuel ratio correction value obtained after the second air-fuel ratio correction value is set by the setting means is within a second predetermined range; and decision making means, coupled to the comparator means, for making a decision that a fault has occurred in the fuel injection system when the second comparator means determines that the first air-fuel ratio correction value is outside of the second predetermined range.

A further object of the present invention is to provide a fuel injection system having the above-mentioned apparatus.

This object of the present invention is achieved by a fuel injection control system for controlling an internal combustion engine, the fuel injection control system comprising:

an oxygen sensor for detecting a concentration of oxygen contained in an exhaust gas emitted from the internal combustion engine;

first operation means, coupled to the oxygen sensor, for calculating a first air-fuel ratio correction value based on the concentration of oxygen so that an air-fuel ratio is equal to a target air-fuel ratio;

second operation means, coupled to the first operation means, for generating a second air-fuel ratio correction value so that the first air-fuel ratio correction value is within a first predetermined range;

air-fuel ratio correction means, coupled to the first and second operation means, for correcting a fuel injection period of a fuel injection value of the internal combustion engine on the basis of the first and second air-fuel ratio correction values;

first comparator means, coupled to the first operation means, for comparing the first air-fuel ratio correction value with a first upper limit value and a first lower limit value;

setting means, coupled to the first comparator means, for forcibly setting the second air-fuel ratio correction value to a second upper limit value when it is determined by the first comparator means that the first air-fuel correction value has reached the first upper limit value and for forcibly setting the second air-fuel ratio correction value to a second lower limit value when it is determined by the first comparator means that the first air-fuel ratio correction value has reached the first lower limit value;

second comparator means, coupled to the setting means, for determining whether or not the first air-fuel ratio correction value obtained after the second air-fuel ratio correction value is set by the setting means is within a second predetermined range; and decision making means, coupled to the comparator means, for making a decision that a fault has occurred in the fuel injection system when the second comparator means determines that the first air-fuel ratio correction value is outside of the second predetermined range.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1:
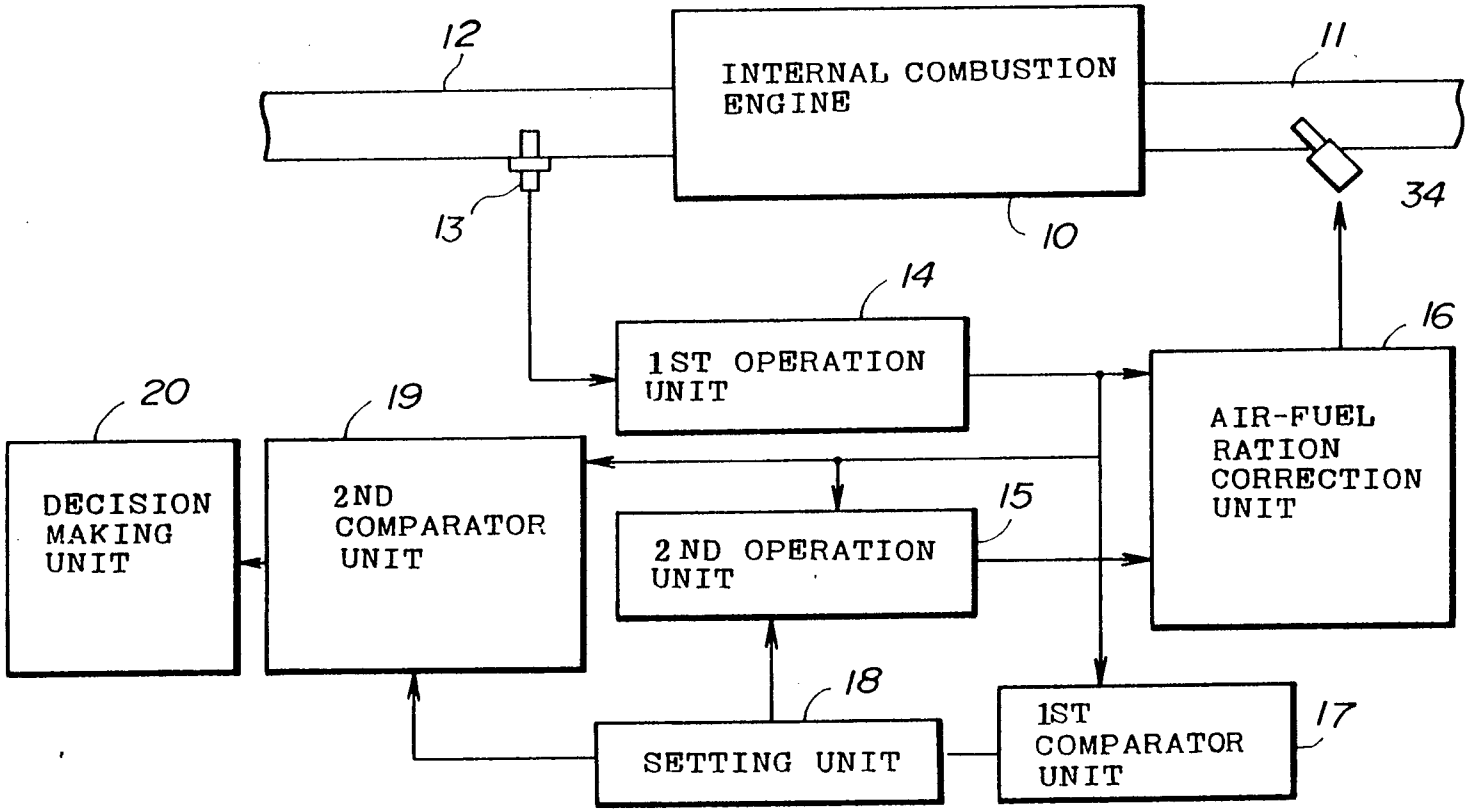
FIG. 1 is a block diagram showing an outline of the present invention.

FIG. 1 is a block diagram showing an outline of an embodiment of the present invention. An oxygen sensor 13, such as an $O_2$ sensor, is fastened to an exhaust passage 12 of an internal combustion engine 10. The sensor 13 detects the concentration of oxygen contained in an exhaust gas. A first operation unit 14 calculates an air-fuel ratio feedback correction value which makes the air-fuel ratio equal to a target air-fuel ratio. A second operation unit 15 calculates an air-fuel ratio correction value different from the above-mentioned air-fuel ratio feedback correction value. An air-fuel ratio correction unit 16 corrects a fuel injection period (injection quantity) of a fuel injection valve 34 fastened to an intake manifold 11 on the basis of the above-mentioned air-fuel feedback correction value and the air-fuel ratio correction value. A first comparator unit 17 compares the air-fuel ratio feedback correction value with a first upper limit value and a first lower limit value. A setting unit 18 forcibly sets the air-fuel ratio correction value to a second upper limit value irrespective of the air-fuel ratio calculated by the second operation unit 15 when an output signal of the first comparator unit 17 shows that the air-fuel ratio feedback correction value has reached the first upper limit value. Further, the setting unit forcibly sets the air-fuel ratio correction value to a second lower limit value irrespective of the air-fuel ratio calculated by the second operation unit 15 when the output signal of the first comparator has reached the first lower limit value. A second comparator 19 determines whether or not the air-fuel ratio feedback correction value calculated by the first operation unit 14 before the air-fuel ratio correction value is set by the setting unit 18 is a value within a predetermined range. A decision making unit 20 makes a decision that a fault has occurred in the fuel injection system when an output signal of the second comparator unit 19 shows that the air-fuel ratio correction value is outside of the predetermined range.

The air-fuel ratio feedback correction value is calculated so that the air-fuel ratio is always equal to the target air-fuel ratio. Hence, the air-fuel ratio feedback correction value is increased (fuel to be injected is increased) if the air-fuel ratio deviates from the target air-fuel ratio to a lean side, and decreased (fuel to be injected is decreased) if the air-fuel ratio deviates to a rich side. If the air-fuel ratio feedback correction value becomes excessively small due to a fault in, for example, the oxygen sensor 13, the air-fuel mixture becomes lean, and the internal combustion engine is liable to misfire. There is also possibility that the mixture will become rich, and thus abnormal combustion is liable to take place. With the above in mind, the first lower and upper limit values are defined.

According to the present invention, the setting unit 18 forcibly sets the air-fuel ratio correction value to the second upper or lower limit value if the air-fuel ratio feedback correction value has become equal to the first upper or lower limit value. By this setting of the air-fuel ratio correction value, the air-fuel ratio feedback correction value calculated by the first operation unit 14 is corrected so that the injection quantity increases by a predetermined amount. Hence, the air-fuel ratio becomes richer than the target air-fuel ratio if the fuel injection system operates normally. In order to compensate for this increase in the air-fuel ratio, the air-fuel ratio feedback correction value becomes a value smaller than the first upper limit value. However, if the fuel injection system has a fault, a sufficient injection quantity is not obtained even when the injection quantity is increased in the above-mentioned manner. Hence, the air-fuel ratio feedback correction value does not change at all or changes only a little. Similarly, if the air-fuel ratio feedback correction value has become equal to the first lower limit value, the air-fuel ratio feedback correction value becomes greater than the first lower limit value only when the fuel injection system operates normally because the injection quantity is decreased by the setting of the second lower limit value.

With the above in mind, the decision making unit 20 makes a decision that the fuel injection system is operating normally if the air-fuel ratio feedback correction value becomes within the predetermined range after the setting of the upper and lower limit values of the air-fuel ratio correction value. If the air-fuel ratio feedback correction value is outside of the predetermined setting range, the decision making unit 20 makes a decision that a fault has occurred in the fuel injection system. By the setting of the upper and lower limit values of the air-fuel ratio correction value, the air-fuel ratio feedback correction value becomes a value within the predetermined setting range other than the first upper or lower limit value if the fuel injection system operates normally. Hence, it is possible to execute the normal air-fuel ratio feedback control process in which the air-fuel ratio feedback correction value changes in accordance with the air-fuel ratio.

Figure 2:
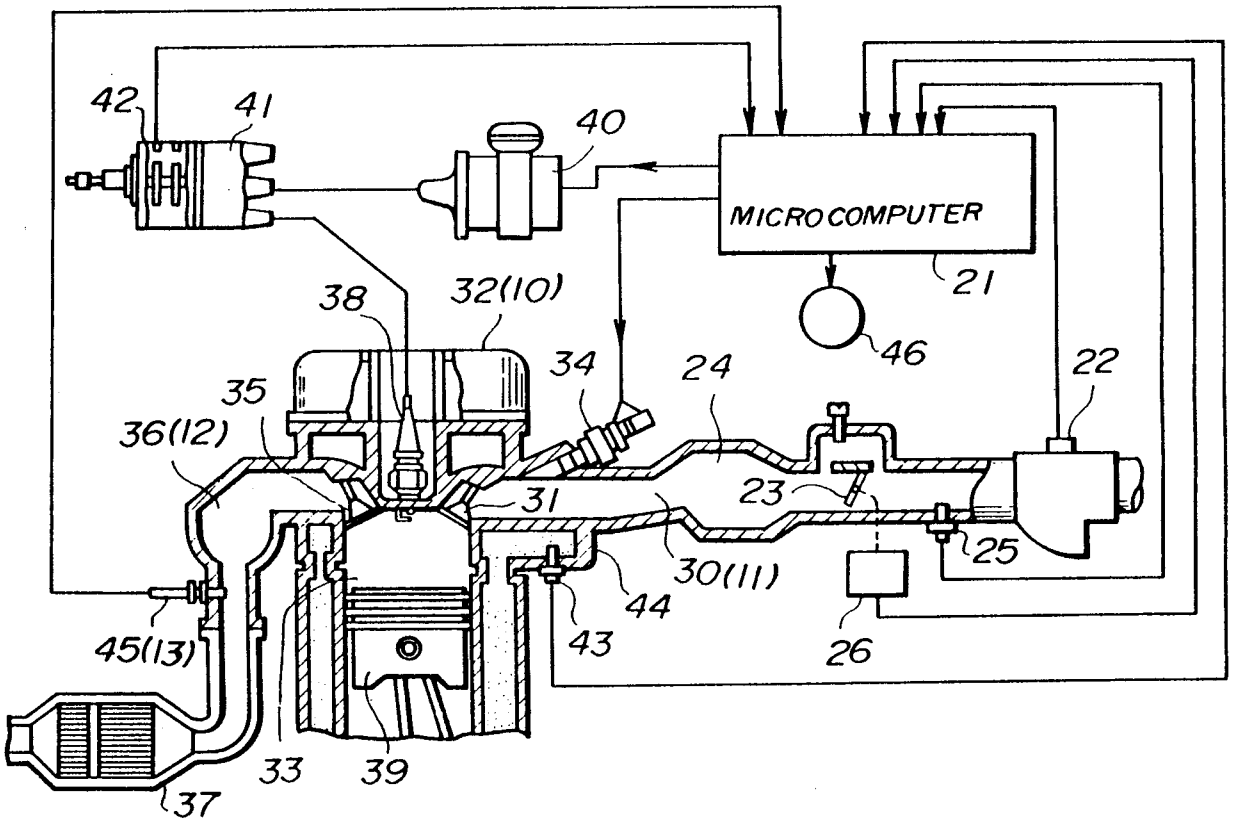
FIG. 2 is a system block diagram of an electronic control type fuel injection apparatus equipped with the present invention.

FIG. 2 is a system block diagram of an electronic control type fuel injection apparatus equipped with the present invention. In FIG. 2, parts which are the same as those shown in FIG. 1 are given the same reference numerals. The embodiment of the present invention shown in FIG. 2 is applied to a four-cylinder four-cycle spark ignition type internal combustion engine. As will be described later, the engine is controlled by a microcomputer 21.

Referring to FIG. 2, a surge tank 24 is provided on the downstream side of an air flow meter 22. A throttle valve 23 is interposed between the air flow meter 22 and the surge tank 24. An intake temperature sensor 25, which detects an intake temperature, is located in the vicinity of the air flow meter 22. An idle switch 26, which turns ON when the throttle valve 23 is maintained in a completely closed state, is fastened to the throttle valve 23.

The surge tank 24 is coupled to a combustion chamber 33 of an engine 32 (which corresponds to the internal combustion engine 10 shown in FIG. 1) via an intake manifold 30 (which corresponds to the intake passage 11 shown in FIG. 1) and an intake valve 31. A fuel injection valve 34 is provided for each cylinder so that it partially projects in the intake manifold 30. The fuel injection valve 34 injects fuel into air passing through the intake manifold 30.

The combustion chamber 33 is coupled to a catalyst device 37 via an exhaust valve 35 and an exhaust manifold 36 (which corresponds to the exhaust passage 12 shown in FIG. 1). An ignition plug 38 is provided so that a plug gap thereof is within the combustion chamber 33. A piston 39 reciprocates in the up and down directions in FIG. 2.

An ignitor 40 generates a high voltage, which is distributed to the ignition plugs 38 of the cylinders by a distributor 41. A turning angle sensor 42 is a sensor which detects revolutions of a shaft of the distributor 42 and generates an engine revolution signal every 30° CA (Crank Angle).

A water temperature sensor 43, which is provided so that it partially penetrates an engine block 44 and projects in a water jacket, generates a water temperature signal indicative of the temperature of water for cooling the engine. An oxygen sensor ($O_2$ sensor) 45 (which corresponds to the oxygen sensor 13 shown in FIG. 1) is disposed so that it partially penetrates the exhaust manifold 36 and partially projects therefrom. The oxygen sensor 45 detects the concentration of oxygen contained in the exhaust gas before it enters the catalyst device 37. An alarm lamp 46 is connected to the microcomputer 21 and notifies a driver of the occurrence of an abnormality in the fuel injection system.

Figure 3:
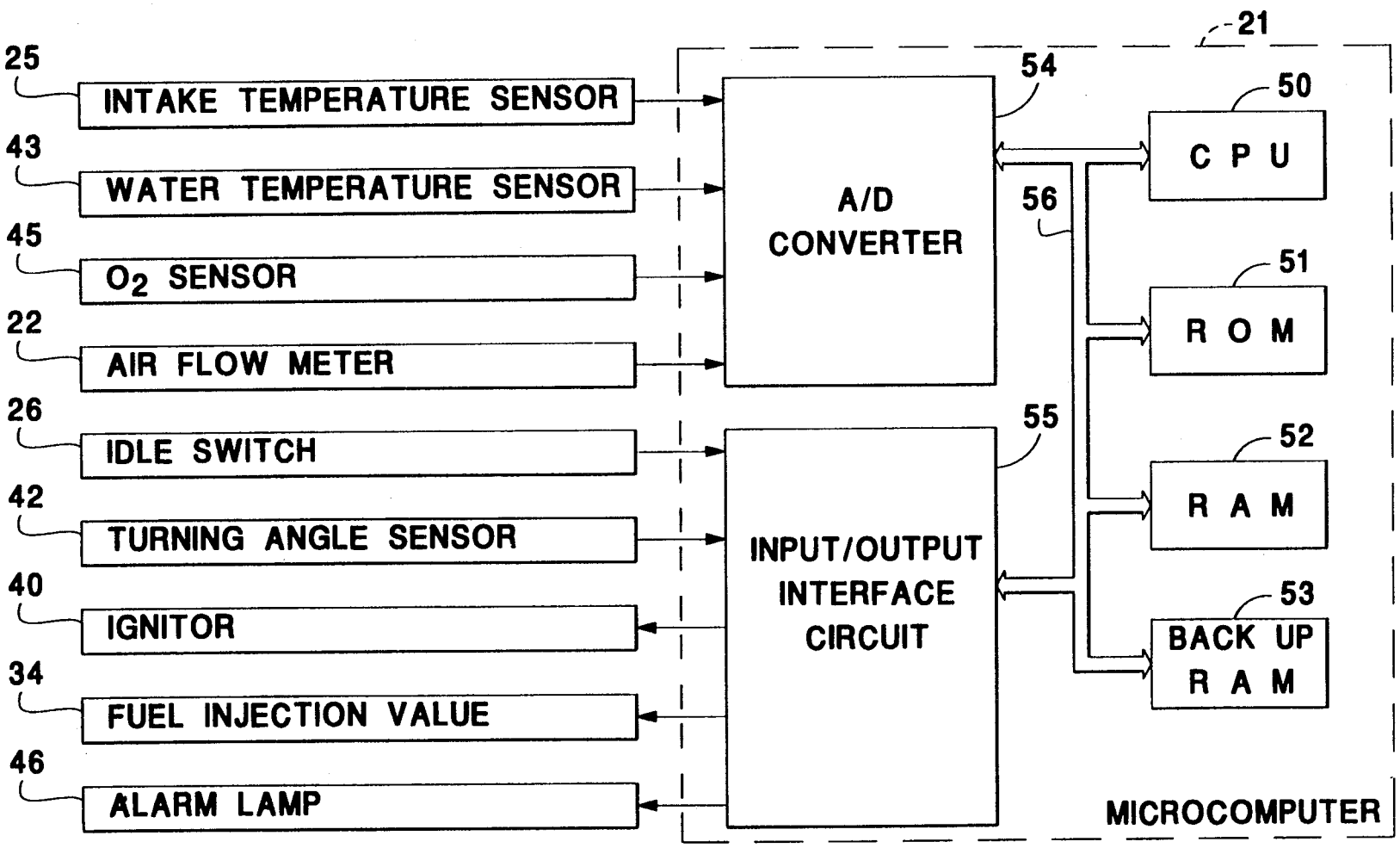
FIG. 3 is a block diagram of a hardware structure of a microcomputer shown in FIG. 2.

The microcomputer 21 which controls the above-mentioned structural parts is configured as shown in FIG. 3, in which those parts which are the same as those shown in FIG. 2 are given the same reference numerals. As shown in FIG. 3, the microcomputer 21 is composed of a CPU (Central Processing Unit) 50, a ROM (Read Only Memory) 51 storing process programs, a RAM (Random Access Memory) 52 used as a working area, a battery backup RAM 53 which stores data after the engine is turned OFF, an A/D (Analog to Digital) converter 54 having a multiplexer, and an input/output interface circuit 55. These elements are coupled to one another via a bus 56.

The A/D converter 54 selectively inputs an intake air quantity detection signal from the air flow meter 22, the intake temperature detection signal from the intake temperature sensor 25, the water temperature detection signal from the water temperature sensor 43, and the oxygen concentration detection signal from the $O_2$ sensor 45, and converts these analog signals into digital signals, which are successively sent to the bus 56.

The input/output interface circuit 55 inputs a detection signal from the idle switch 26, and an engine speed signal (corresponding to revolutions (NE) of the engine) from the turning angle sensor 42, and transfers these signals to the CPU 50 via the bus 56. Further, the input/output interface circuit 55 receives signals input via the bus 56 to the fuel injection valve 34, the ignitor 40 and the alarm lamp 46. Thereby, a fuel injection period TAU of the fuel injection valve 34 is controlled, and an ignition signal of the ignitor 40 is applied so that a primary current passing through an ignition coil is interrupted and hence the ignition plug 38 is sparked.

The microcomputer 21 is an electronic device which implements, by software, the aforementioned first operation unit 14, the second operation unit 15, the air-fuel ratio correction unit 16, the first and second comparator units 17 and 19, the setting unit 18, and the decision making unit 20. The microcomputer 21 executes various processes in accordance with programs stored in the ROM 51.

In order to control the fuel injection valve 34, the air-fuel ratio correction unit 16 calculates the fuel injection period TAU of the fuel injection valve 34 in accordance with the following formula:

$$TAU = TP \times FAF \times FGHAC \times K \quad (1)$$

where TP denotes a basic fuel injection period, FAF denotes an air-fuel ratio feedback correction factor (value), FGHAC denotes an air-fuel ratio correction value with respect to a change in the altitude, K is a correction coefficient based on the water temperature, the intake temperature and so on. The basic fuel injection period TP is calculated based on the intake quantity Q and the engine speed NE.

Figure 4:
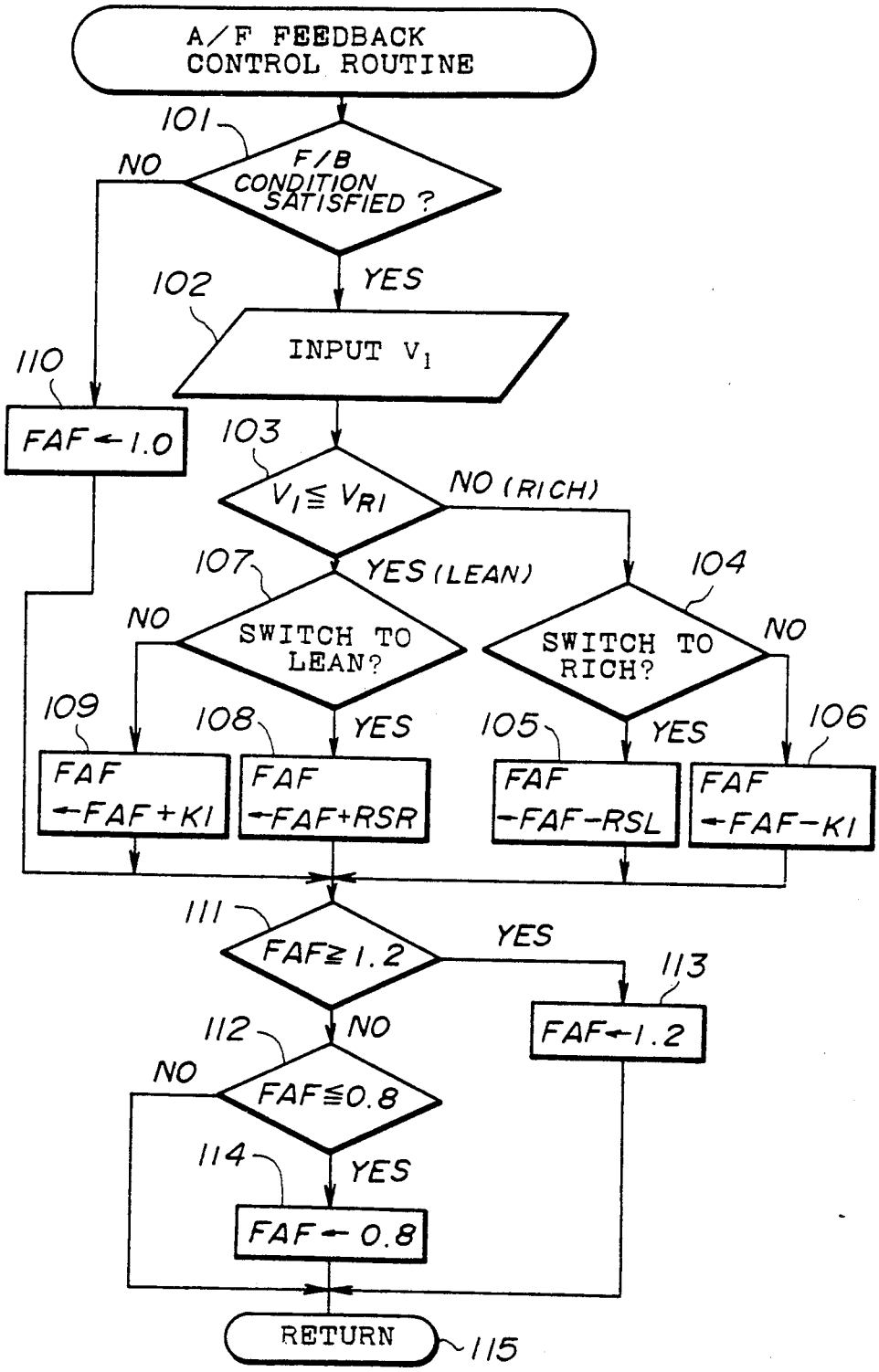
FIG. 4 is a flowchart of an air-fuel ratio feedback control routine executed by the microcomputer shown in FIG. 3.
Figure 5:
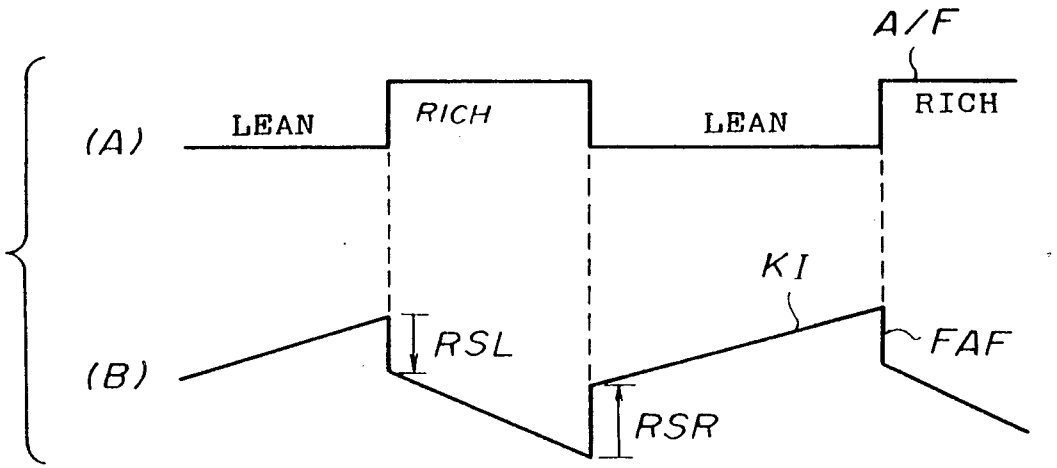
FIG. 5 is a diagram showing the relationship between the air-fuel ratio and an air-fuel ratio feedback correction factor.

A description will now be given, with reference to FIGS. 4 and 5, of a process which implements the first operation unit 14. In the embodiment of the present invention, the air-fuel ratio feedback correction factor FAF is calculated by an A/F (Air-Fuel ratio) feedback control routine shown in FIG. 4. The routine shown in FIG. 4 is activated every 4ms. At the commencement of the routine, the microcomputer 21 determines, at step 101, whether or not a feedback (F/B) control condition has been satisfied. If the engine is maintained in any of the following conditions, the feedback control condition is not satisfied: (1) the water temperature is equal to or lower than a predetermined temperature; (2) the engine is in the starting mode; (3) an increased amount of fuel is being injected after the engine is started; (4) an increased amount of fuel is being injected in the warm-up state; (4) the engine is in a power-based fuel increasing state; and (5) the engine is in the fuel-cut-off state. When it is determined that the feedback control condition is not satisfied, the microcomputer 21 sets the air-fuel ratio feedback correction factor FAF to 1.0 at step 110, and executes step 111.

When it is determined that the feedback control condition is satisfied (that is, the engine is not maintained in any of the conditions (1)-(5)), the microcomputer 21 executes step 102, at which step a detection voltage V1 of the $O_2$ sensor is input. At step 103, the microcomputer 21 determines whether the mixture is rich or lean by determining whether or not the detection voltage V1 is lower than or equal to a threshold voltage $V_{R1}$. When the mixture is rich ($V1 > V_{R1}$), the microcomputer 21 determines, at step 104, whether or not the mixture has switched from a lean condition to the current rich condition. When the result obtained at step 104 is YES, the microcomputer 21 subtracts a skip constant RSL from the previous value of the air-fuel ratio feedback correction factor FAF, and sets the result of this subtraction to be the updated value of the air-fuel ratio feedback correction factor FAF at step 105. When the mixture is determined to be rich at the previous determination step and the rich condition continues, the microcomputer 21 subtracts an integration constant KI from the previous value of the air-fuel ratio feedback correction factor FAF, and sets the result of this subtraction to be the updated value of the FAF at step 106. Then, the microcomputer 21 executes step 111.

When it is determined, at step 103, that the mixture is lean ($V1 \leqq V_{R1}$), the microcomputer 21 determines, at step 107, whether or not the mixture has switched to the current lean condition from a rich condition. When it is determined that the previous condition of the mixture was rich, the microcomputer 21 adds a skip constant RSR to the previous value of the air-fuel ratio feedback correction factor FAF, and sets the result of this addition to be the updated value of the FAF at step 108. When it is determined that the previous condition of the mixture was lean and the current condition thereof is continuously lean, the microcomputer 21 adds the integration constant KI to the value of the FAF, and sets the result of this addition to be the updated value of the FAF at step 109. The skip constants RSL and RSR are set to be sufficiently greater than the integration constant KI.

At step 111, the microcomputer 21 determines whether or not the value of the air-fuel ratio feedback correction factor FAF is larger than or equal to 1.2. When the result of this determination is affirmative, the microcomputer 21 determines whether or not the value of the FAF is smaller than or equal to 0.8. When it is determined, at step 111, that the value of the air-fuel ratio feedback correction factor FAF is larger than or equal to 1.2, the microcomputer 21 sets the value of the FAF to 1.2 at step 113. When the result obtained at step 112 is YES, the microcomputer 21 sets the value of the FAF to 0.8 at step 114. When the result obtained at step 112 is NO, the procedure shown in FIG. 4 ends. After step 113 is executed, the procedure shown in FIG. 4 also ends.

If the air-fuel ratio changes as shown in FIG. 5(A), the value of the air-fuel ratio feedback correction factor FAF changes as shown in FIG. 5(B). More specifically, when the mixture switches from a lean condition to a rich condition, the value of the FAF is greatly stepwise decreased by the skip constant RSL, and hence the fuel injection period TAU calculated by formula (1) is shortened. When the mixture switches from a rich condition to a lean condition, the value of the air-fuel ratio feedback correction factor FAF is greatly stepwise increased by the skip constant RSR, and hence the fuel injection period TAU is lengthened. When the current condition of the mixture is the same as the previous condition thereof, as shown in FIG. 5(B), the value of the FAF is gradually increased by the integration constant (time constant) KI when the mixture is lean, and gradually decreased by the integration constant KI when the mixture is rich.

A description will now be given, with reference to FIGS. 6 and 7, of a process which implements the second operation unit 15. In the present embodiment, the air-fuel ratio correction value FGHAC with respect to a change in the altitude is calculated by learning control routines shown in FIGS. 6 and 7. The air-fuel ratio correction value FGHAC decreases as the altitude increases. This value FGHAC is used to prevent the mixture from becoming rich as the altitude increases.

Figure 6:
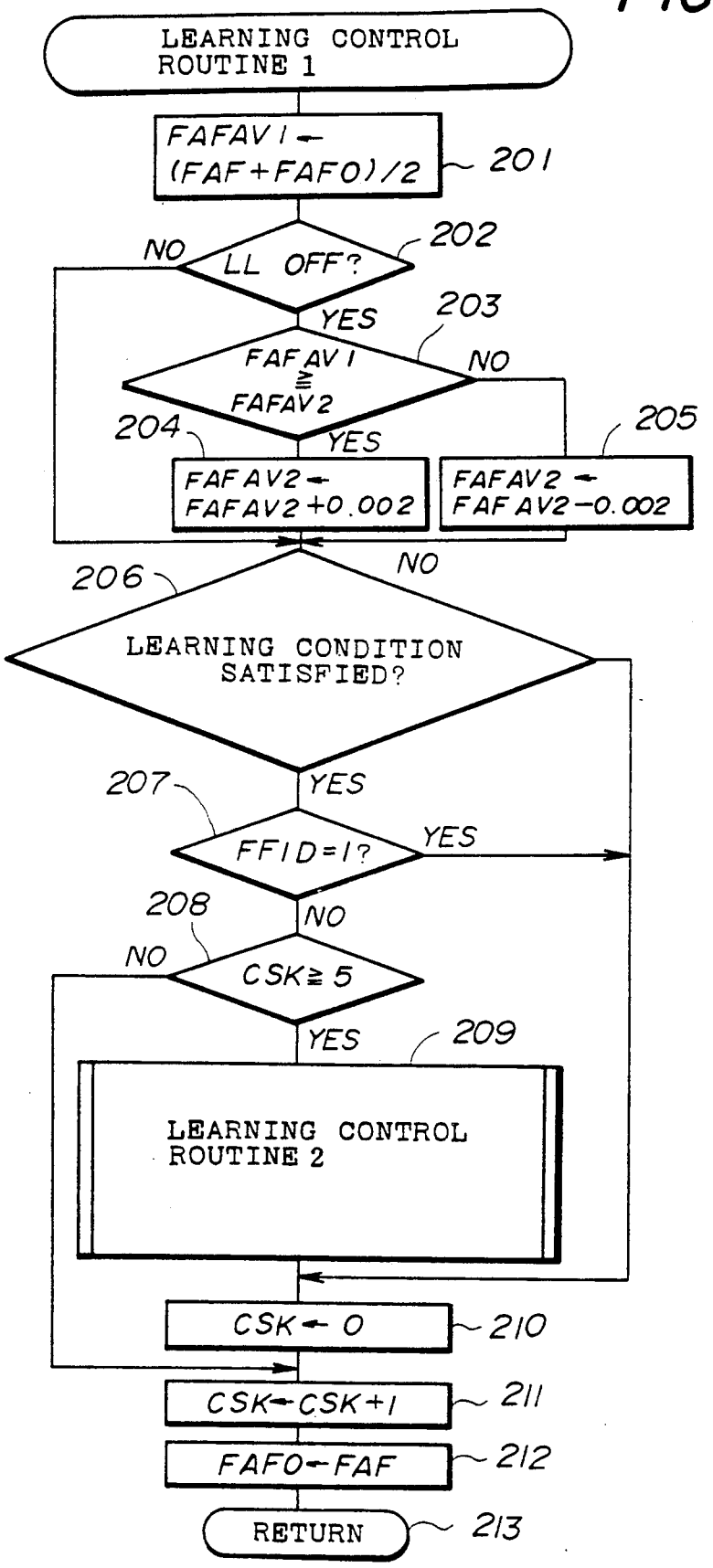
FIG. 6 is a flowchart of a learning control routine.

The learning control routine shown in FIG. 6 is activated each time the value of the air-fuel ratio feedback correction factor is stepwise changed. At step 201, the microcomputer 21 Calculates an average FAFAV1 of the current value of the air-fuel ratio feedback correction factor FAF and the previously obtained value (labeled FAFO) thereof. At step 202, the microcomputer 21 determines whether or not the idle switch (LL) is OFF, that is, whether or not the throttle value 23 is in the opened state. When the throttle valve 23 is in the opened state, the microcomputer 21 compares the average value FAFAV1 with a weighted average FAFAV2 of the FAFAV1 at step 203. The initial value of the weighted average FAFAV2 is made equal to 1.0 by an initial routine. When it is determined, at step 203, that $FAFAV1 \geqq FAFAV2$, 0.002 is added to the FAFAV2 at step 204. When it is determined, at step 204, that $FAFAV1 < FAFAV2$, 0.002 is subtracted from the FAFAV2 at step 205.

At step 206, the microcomputer 21 determines whether or not a learning condition has been satisfied after step 204 or step 205 is executed or when it is determined, at step 202, that the idle switch 26 is ON. This learning condition is such that the air-fuel ratio feedback control is being performed or the temperature of water for cooling the engine is higher than or equal to 80° C. When the learning condition has been satisfied, the microcomputer 21 determines whether or not an abnormality detection in-processing flag FFID is equal to "1", which is set at step 407 of an abnormality decision routine shown in FIG. 8 as will be described later. When the flag FFID is not equal to "1" (that is, equal to "0"), the microcomputer 21 determines, at step 208, whether or not the value of a counter CSK indicating the number of executions of the present routine is larger than or equal to "5". When $CSK \geqq 5$, the microcomputer 21 executes the routine shown in FIG. 7, and resets the value of the counter CSK to zero at step 210.

When it is determined, at step 206, that the learning condition is not satisfied, or when it is determined, at step 207, that the flag FFID is equal to "1" (that is, the abnormality detection procedure is being executed), at step 210 the microcomputer 21 resets the value of the counter CSK to zero without executing the learning control routine at step 209.

When the value of the counter CSK is smaller than "5", or after the counter CSK is reset at step 210, the value of the counter CSK is incremented by "1" at step 211. At step 212, the microcomputer 21 writes the current value of the air-fuel ratio feedback correction factor FAF into the FAFO, and ends the routine at step 213.

The learning control routine executed at step 209 will now be described with reference to FIG. 7. At step 301, the microcomputer 21 determines whether or not the throttle valve 23 is in the fully closed state. When the result of this determination is YES, the microcomputer 21 determines, at step 302, whether or not the weighted average FAFAV2 is larger than or equal to "1.0". When it is determined that FAFAV2≧1.0, the microcomputer 21 determines, at step 303, whether or not the average value FAFAV1 is larger than or equal to "1.02". When the result of this determination is affirmative, the microcomputer 21 determines that the air-fuel ratio has deviated to a lean side, and calculates the following formulas at step 304:

$$FGHAC=FGHAC+0.002 \quad (2)$$

$$FAFAV2=FAFAV2-0.002 \quad (3).$$

On the other hand, when it is determined at step 302 that the weighed average FAFAV2 is smaller than "1.0", the microcomputer 21 determines whether or not the average FAFAV1 is smaller than "0.98" at step 305. When it is determined that FAFAV1<0.98, the microcomputer 21 determines that the air-fuel ratio has deviated to a rich side, and calculates the following formulas at step 306:

$$FGHAC=FGHAC-0.002 \quad (4)$$

$$FAFAV2=FAFAV2+0.002 \quad (5)$$

After step 304 or step 305 is executed, or when it is determined at steps 303 and 305, that 0.9≦FAFAV1≦1.02, the microcomputer 21 executes a guard process starting from step 311.

On the other hand, when it is determined, at step 301, that the throttle valve 23 is not in the completely closed state by referring to the output signal of the idle switch 26, the microcomputer 21 determines, at steps 307 and 309, whether or not 0.98≦FAFAV1≦1.02. When FAFAV1>1.02, the microcomputer 21 increases the air-fuel correction value FGHAC by "0.002" at step 308. When FAFAV1<0.98, the microcomputer 21 decreases the air-fuel ratio correction value FGHAC by "0.002" at step 310. When 0.98≦FAFAV1≦1.02, the microcomputer 21 executes the guard process starting from step 311 without varying the air-fuel ratio correction value FGHAC.

At steps 311 and 312, the microcomputer 21 determines whether or not the air-fuel ratio correction value FGHAC is between an upper limit value FGHACMAX (equal to, for example, 1.1) and a lower limit value FGHACMIN (equal to, for example, 0.9). When it is determined that FGHACMIN<FGHAC<FGHACMAX, the microcomputer 21 ends the routine at step 315. When it is determined that FGHAC≧FGHACMAX, the microcomputer 21 sets the FGHAC to the upper limit value FGHACMAX at step 313. When FGHAC≦FGHACMIN, the microcomputer 21 sets the FGHAC to the lower limit value FGHACMIN at step 314, and ends the routine at step 315. It will be noted that FGHACMAX corresponds to the aforementioned second upper limit value and FGHACMIN corresponds to the aforementioned second lower limit value.

Figure 7:
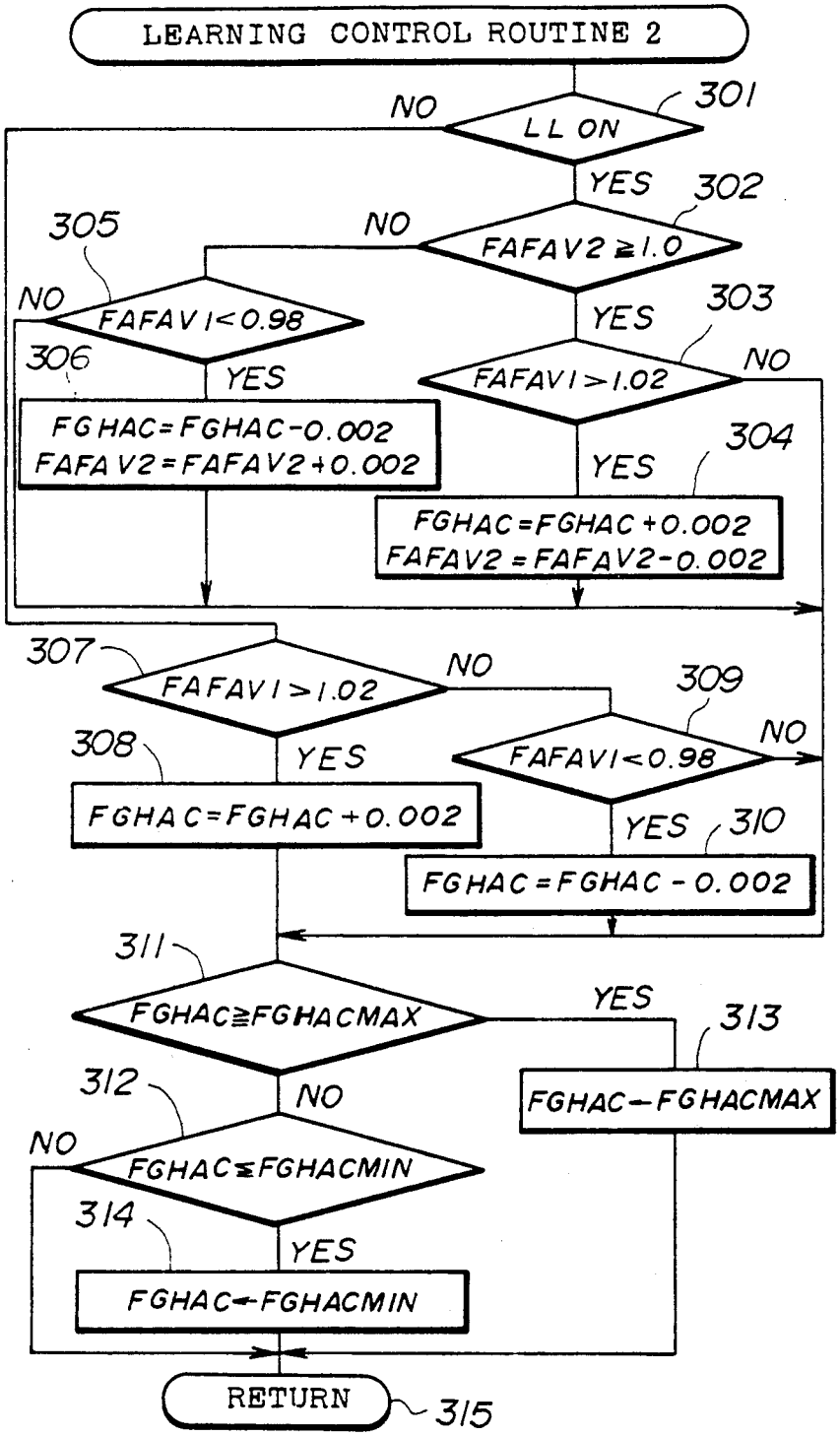
FIG. 7 is a flowchart of a learning control routine executed in the routine shown in FIG. 6.

In this manner, the learning control routine shown in FIG. 7 functions so that the average FAFAV1 is between 0.98 and 1.02 (0.98≦FAFAV1≦1.02).

The air-fuel ratio correction value FGHAC thus calculated corrects, together with the air-fuel ratio feedback correction factor FAF, the basic fuel injection period TP. With this arrangement, the above-mentioned operation is continuously executed under a condition where the throttle valve 23 is continuously maintained in the fully closed state for a long time, as in a case where a vehicle is traveling from a high altitude place to a low altitude place. Further, if the mixture is rich in a high altitude place, the air-fuel ratio correction value FGHAC is controlled so that it decreases according to the present embodiment (step 306 shown in FIG. 7). Hence, it becomes possible to reduce the influence of altitude on the air-fuel ratio.

Figure 8:
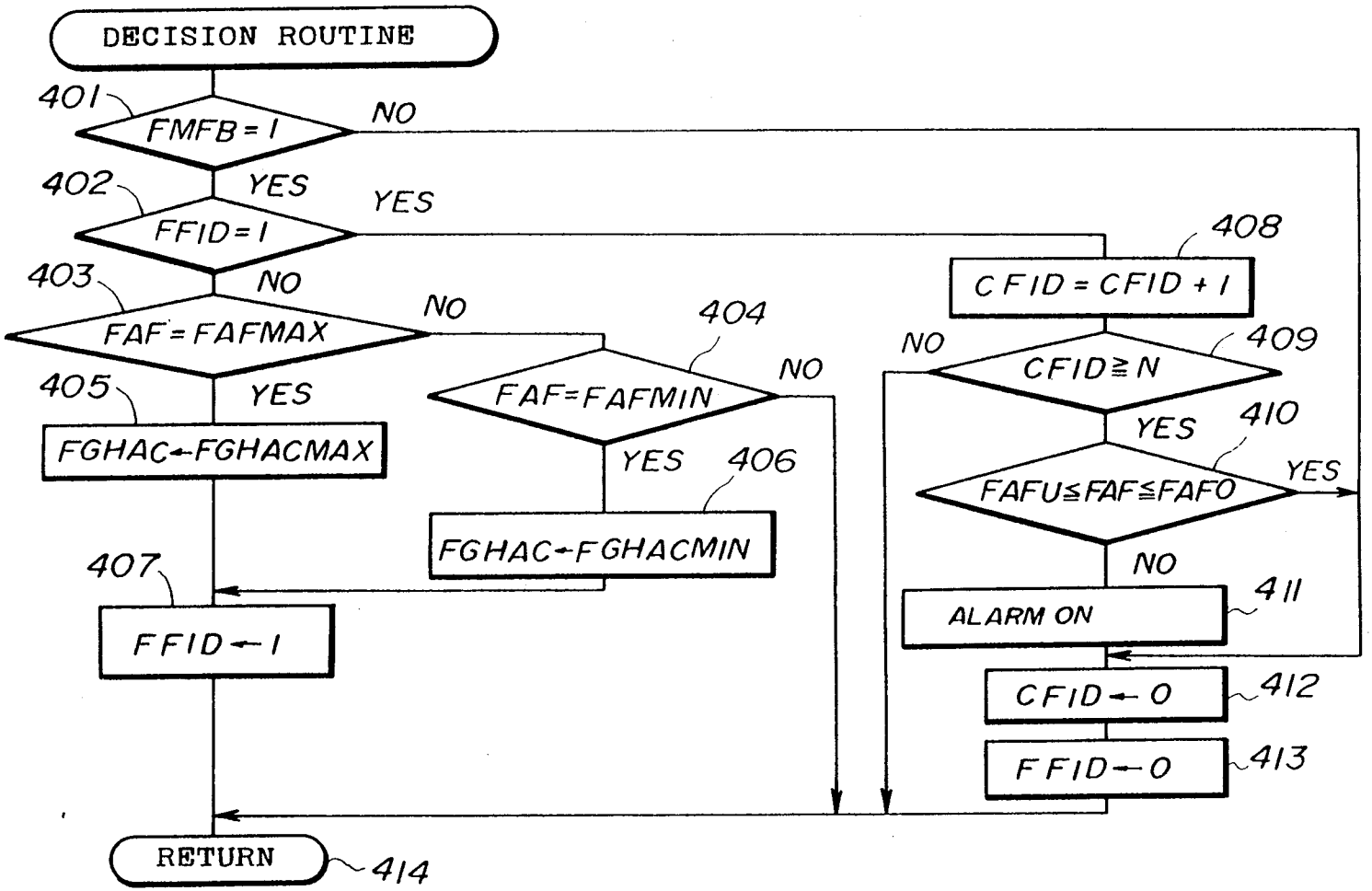
FIG. 8 is a flowchart of an abnormality detection decision routine which is an essential part of the present invention.

A description will now be given, with reference to FIG. 8, of an abnormality decision routine which implements the aforementioned first and second comparator units 17 and 19, the setting unit 18 and the decision making unit 20 shown in FIG. 1. The abnormality decision routine shown in FIG. 8 is activated every 65.5 ms. At step 401, the microcomputer 21 determines whether or not the air-fuel ratio feedback control condition (identical to that used at step 101) has been satisfied by referring to the value of a flag FMFB . When the result of this determination is NO, the microcomputer 21 executes step 412. When the result of this determination is YES (FMFB=1), the microcomputer 21 determines, at step 402, whether or not the present abnormality detection routine is being executed by referring to the flag FFID. The initial value of the flag FFID is set to "0" by the initial routine. Hence, the microcomputer 21 directly executes step 402 when step 402 is executed for the first time. At step 402, the microcomputer 21 determines whether or not the value of the air-fuel ratio feedback correction factor FAF has reached the first upper limit value FAFMAX (equal to, for example, 1.20). When the result of this determination is negative, the microcomputer 21 determines, at step 404, whether or not the value of the air-fuel ratio feedback correction factor FAF has reached the first lower limit value FAFMIN (equal to, for example, 0.8). When the result of this determination is also negative, the microcomputer 21 makes a decision that the air-fuel ratio feedback control procedure is normally executed, and ends this routine at step 414.

When it is determined, at step 403, that the value of the air-fuel ratio feedback correction factor FAF has reached the upper limit value FAFMAX, the microcomputer 21 inserts its upper limit value (the second upper limit value) into the FGHACMAX at step 405. When it is determined, at step 404, that the air-fuel ratio feedback correction factor FAF has reached the lower limit value FAFMIN, the microcomputer 21 inserts its lower limit value (the second lower limit value) into the FGHACMIN at step 406. After step 405 or step 406 is executed, the microcomputer 21 sets the value of the flag FFID to "1" at step 407, and ends the present routine. The first comparator unit 17 shown in FIG. 1 is implemented by steps 403 and 404, and the setting unit 18 also shown in FIG. 1 is implemented by steps 405 and 406.

When the above-mentioned abnormality decision routine is activated again and the feedback control condition has been satisfied, it is determined, at step 402, that FFID=1. The microcomputer 21 executes step 408, at which step the value of the counter CFID is increased by "1". Subsequently, the microcomputer 21 determines, at step 409, whether or not the value of the counter CFID obtained after the above increment is larger than or equal to a predetermined value N. When CFID<N, the present routine is ended at step 414.

Thereafter, a routine consisting of the steps 401, 402, 408, 409 and 414 is repeatedly executed. When it is determined, at step 409, that CFID≧N (N is a predetermined count number), the microcomputer 21 executes step 410, at which step it is determined whether or not the value of the air-fuel feedback correction factor FAF is within a range between FAFU and FAFO, where FAFU is a lower setting value (equal to, for example, 1.1) smaller than the upper limit value FAFMAX and FAFO is an upper setting value (equal to, for example, 0.9) larger than the lower limit value FAFMIN. Step 410 is not executed until CFID becomes equal to or greater than the predetermined count number N (N amounts to about 3 seconds) in order to discriminate an abnormality in the fuel injection system from external turbulence. Step 410 implements the aforementioned second comparator unit 19 shown in FIG. 1.

If the mixture is too lean and hence the air-fuel ratio feedback correction factor FAF has reached the upper limit value FAFMAX, the injection quantity is further increased by FGHACMAX by executing step 405. Hence, if the fuel injection system is operating normally, the air-fuel ratio is controlled so that the mixture becomes rich. In response to this control procedure, the value of the air-fuel ratio feedback correction factor FAF becomes smaller than the upper limit value FAFMAX. If the mixture is too rich and hence the air-fuel ratio feedback correction factor FAF has reached the lower limit value FAFMIN, the injection quantity is further decreased by executing step 406. Hence, if the fuel injection system is operating normally, the air-fuel ratio is controlled so that the mixture becomes lean. In response to this control procedure, the value of the air-fuel ratio feedback correction factor FAF becomes larger than the lower limit value FAFMIN.

When the value of the air-fuel ratio feedback correction factor FAF becomes smaller than the upper limit value FAFMAX and larger than the lower limit value FAFMIN by the above-mentioned control procedure, the normal air-fuel ratio feedback control process in which the FAF is changed in response to a change in the air-fuel ratio is started. Thereby ,the air-fuel ratio is controlled so that it becomes equal to the target air-fuel ratio, and hence the exhaust emissions can be reduced.

On the other hand, if the fuel injection system malfunctions, the injection quantity does not change at all or changes only a little. Thus, the value of the air-fuel ratio feedback correction factor FAF remains at the upper limit value FAFMAX, the lower limit value FAFMIN, or a value close thereto.

When the result obtained at step 410 is YES, the microcomputer 21 determines that the fuel injection system is operating normally, and resets the counter CFID and the flag FFID to "0" at steps 412 and 413, respectively. Then, the microcomputer 21 ends the routine shown in FIG. 8.

When it is determined, at step 410, that FAF>FAFO or FAF<FAFU, the microcomputer 21 determines that a fault has occurred in the fuel injection system, and turns the alarm lamp 46 ON at step 411. After this, the microcomputer 21 successively executes the steps 412 and 413, and ends the routine shown in FIG. 8. The decision making unit 20 shown in FIG. 1 is implemented by step 411.

According to the embodiment of the present invention, it is determined that a fault has occurred in the fuel injection system not only when the value of the air-fuel ratio feedback correction factor FAF has reached the upper limit value FAFMAX or the lower limit value FAFMIN, but also when the value of the FAF is larger than the upper setting value FAFO but smaller than the upper limit value FAFMAX or larger than the lower limit value FAFMIN but smaller than the lower setting value FAFU. As a result, it is possible to turn the alarm lamp 46 ON immediately before the amount of exhaust emissions becomes larger than a limited value.

The present invention is not limited to the specifically disclosed embodiment of the present invention. The air-fuel ratio feedback correction value calculated by the first operation unit 14 is limited to the air-fuel ratio correction factor FAF, but instead may be FAFAV1 or FAFAV2. The air-fuel ratio correction value calculated by the second operation unit 15 is not limited to the air-fuel ratio correction value FGHAC dependent on the altitude, but instead it may be limited to an injection quantity correction value FGAFM dependent on the deterioration caused by age of the air flow meter 22. It is also possible to use both the values FGHAC and FGAFM. In addition, the present invention can be applied to an internal combustion engine in which the basic fuel injection period TP is calculated based on the intake manifold pressure and the engine speed.

What is claimed is:

1. An apparatus for diagnosing an abnormality in a fuel injection system in which an injection quantity is feedback-controlled by adjusting a first air-fuel ratio correction value so that an air-fuel ratio is equal to a target air-fuel ratio, said apparatus comprising:

operation means for generating a second air-fuel correction value used for adjusting the injection quantity so that said first air-fuel ratio correction value is within a first predetermined range;

first comparator means for comparing said first air-fuel ratio correction value with a first upper limit value and a first lower limit value;

setting means, coupled to said first comparator means, for forcibly setting the second air-fuel ratio correction value to a second upper limit value when it is determined by said first comparator means that said first air-fuel correction value has reached said first upper limit value and for forcibly setting the second air-fuel ratio correction value to a second lower limit value when it is determined by said first comparator means that said first air-fuel ratio correction value has reached said first lower limit value;

second comparator means, coupled to said setting means, for determining whether or not said first air-fuel ratio correction value obtained after said second air-fuel ratio correction value is set by said setting means is within a second predetermined range; and decision making means, coupled to said second comparator means, for making a decision that a fault has occurred in the fuel injection system when said second comparator means determines that said first air-fuel ratio correction value is outside of said second predetermined range.

2. An apparatus as claimed in claim 1, wherein:

said second upper limit value is smaller than said first upper limit value; and said second lower limit value is larger than said first lower limit value.

3. An apparatus as claimed in claim 1, wherein said decision making means comprises means for making said decision that a fault has occurred in the fuel injection system when a predetermined time has elapsed after said second air-fuel ratio correction value is set by said setting means and at this time said second comparator means determines that said first air-fuel ratio correction value is outside of said second predetermined range.

4. An apparatus as claimed in claim 1, wherein said first air-fuel ratio correction value is a value dependent on a concentration of oxygen contained in an exhaust gas.

5. An apparatus as claimed in claim 1, wherein said second air-fuel ratio correction value is a value dependent on altitude.

6. An apparatus as claimed in claim 1, wherein said apparatus comprises alarm means, coupled to said decision making means, for generating an alarm when said decision making means makes said decision that a fault has occurred in the fuel injection system.

7. An apparatus as claimed in claim 3, wherein said predetermined time is a time sufficient to discriminate an abnormality in said fuel injection system from an external turbulence.

8. An apparatus as claimed in claim 1, wherein said second predetermined range is narrower than said first predetermined range.

9. A fuel injection control system for controlling an internal combustion engine, said fuel injection control system comprising:

an oxygen sensor for detecting a concentration of oxygen contained in an exhaust gas emitted from said internal combustion engine;

first operation means, coupled to said oxygen sensor, for calculating a first air-fuel ratio correction value based on the concentration of oxygen so that an air-fuel ratio is equal to a target air-fuel ratio;

second operation means, coupled to said first operation means, for generating a second air-fuel ratio correction value so that said first air-fuel ratio correction value is within a first predetermined range;

air-fuel ratio correction means, coupled to said first and second operation means, for correcting a fuel injection period of a fuel injection valve of the internal combustion engine on the basis of said first and second air-fuel ratio correction values;

first comparator means, coupled to said first operation means, for comparing said first air-fuel ratio correction value with a first upper limit value and a first lower limit value;

setting means, coupled to said first comparator means, for forcibly setting the second air-fuel ratio correction value to a second upper limit value when it is determined by said first comparator means that said first air-fuel correction value has reached said first upper limit value and for forcibly setting the second air-fuel ratio correction value to a second lower limit value when it is determined by said first comparator means that said first air-fuel ratio correction value has reached said first lower limit value;

second comparator means, coupled to said setting means, for determining whether or not said first air-fuel ratio correction value obtained after said second air-fuel ratio correction value is set by said setting means is within a second predetermined range; and decision making means, coupled to said second comparator means, for making a decision that a fault has occurred in the fuel injection system when said second comparator means determines that said first air-fuel ratio correction value is outside of said second predetermined range.

10. A system as claimed in claim 9, wherein:

said second upper limit value is smaller than said first upper limit value; and said second lower limit value is larger than said first lower limit value.

11. A system as claimed in claim 9, wherein said decision making means comprises means for making said decision that a fault has occurred in the fuel injection system when a predetermined time has elapsed after said second air-fuel ratio correction value is set by said setting means and at this time said second comparator means determines that said first air-fuel ratio correction value is outside of said second predetermined range.

12. A system as claimed in claim 9, wherein said second air-fuel ratio correction value is a value dependent on altitude.

13. A system as claimed in claim 9, wherein said apparatus comprises alarm means, coupled to said decision making means, for generating an alarm when said decision making means makes said decision that a fault has occurred in the fuel injection system.

14. A system as claimed in claim 11, wherein said predetermined time is a time sufficient to discriminate an abnormality in said fuel injection system from an external turbulence.

15. A system as claimed in claim 9, wherein said second predetermined range is narrower than said first predetermined range.

* * * * *